US007740439B1

(12) United States Patent
Browning et al.

(10) Patent No.: US 7,740,439 B1
(45) Date of Patent: Jun. 22, 2010

(54) WHEEL LIFTING DEVICE

(76) Inventors: Norman Browning, 4 Banchory St., Essendon, Melbourne, Vi (AU) 3040; Russell C. Hocking, 2 Eyre Close, Taylors Lakes Vic 3038 (AU)

( * ) Notice: Subject to any disclaimer, the term of this patent is extended or adjusted under 35 U.S.C. 154(b) by 552 days.

(21) Appl. No.: 11/675,631

(22) Filed: Feb. 16, 2007

(51) Int. Cl.
*B65B 29/00* (2006.01)

(52) U.S. Cl. ..... 414/428

(58) Field of Classification Search ..... 414/427, 414/428, 426

See application file for complete search history.

(56) References Cited

U.S. PATENT DOCUMENTS

| | | | | | |
|---|---|---|---|---|---|
| 2,545,440 | A * | 3/1951 | Barber | 414/427 |
| 3,788,659 | A * | 1/1974 | Allen | 280/5.24 |
| 3,976,212 | A * | 8/1976 | Sanchez | 414/428 |
| 4,008,862 | A * | 2/1977 | Wilmes | 414/24.6 |
| 4,049,140 | A * | 9/1977 | Roose | 414/24.6 |
| 4,692,082 | A | 9/1987 | Smith | |
| 4,872,694 | A * | 10/1989 | Griesinger | 280/79.4 |
| 5,074,734 | A * | 12/1991 | Price et al. | 414/24.6 |
| 5,112,070 | A | 5/1992 | Hahn | |
| 5,176,487 | A | 1/1993 | Flitton | |
| 5,362,194 | A | 11/1994 | Kassebaum | |
| 5,820,330 | A * | 10/1998 | Focke et al. | 414/427 |
| 6,237,206 | B1 | 5/2001 | Bezemer | |
| 6,430,761 | B1 * | 8/2002 | Brandorff et al. | 5/86.1 |
| D473,692 | S | 4/2003 | Tafoya | |
| 6,942,443 | B2 * | 9/2005 | Shubert | 414/563 |

* cited by examiner

*Primary Examiner*—Charles A Fox

(57) ABSTRACT

A wheel lifting device for facilitating removal of a flat tire and positioning of a replacement tire includes a base bar being positionable on a support surface adjacent a tire. Each of a pair of arms is coupled to the base bar. Each of the arms has one of a pair of rollers rotatably coupled thereto. Each of the rollers is positioned between the arms to engage a tread of the tire. The rollers permit rotation of the tire to allow a rim to be rotated to properly align the rim with a wheel hub.

6 Claims, 3 Drawing Sheets

WHEEL LIFTING DEVICE

BACKGROUND OF THE INVENTION

1. Field of the Invention

The present invention relates to wheel pulling and transporting devices and more particularly pertains to a new wheel pulling and transporting device for facilitating removal of a flat tire and positioning of a replacement tire.

2. Description of the Prior Art

The use of wheel pulling and transporting devices is known in the prior art. While these devices fulfill their respective, particular objectives and requirements, the need remains for a device that has certain improved features that allow for a tire and a rim to be easily rotated so that the rim lines up with studs on a wheel hub. Additionally, the device may have arm that are pivotal to permit a more compact storage of the device.

SUMMARY OF THE INVENTION

The present invention meets the needs presented above by generally comprising a base bar being positionable on a support surface adjacent a tire. Each of a pair of arms is coupled to the base bar. Each of the arms has one of a pair of rollers rotatably coupled thereto. Each of the rollers is positioned between the arms to engage a tread of the tire. The rollers permit rotation of the tire to allow a rim to be rotated to properly align the rim with a wheel hub.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
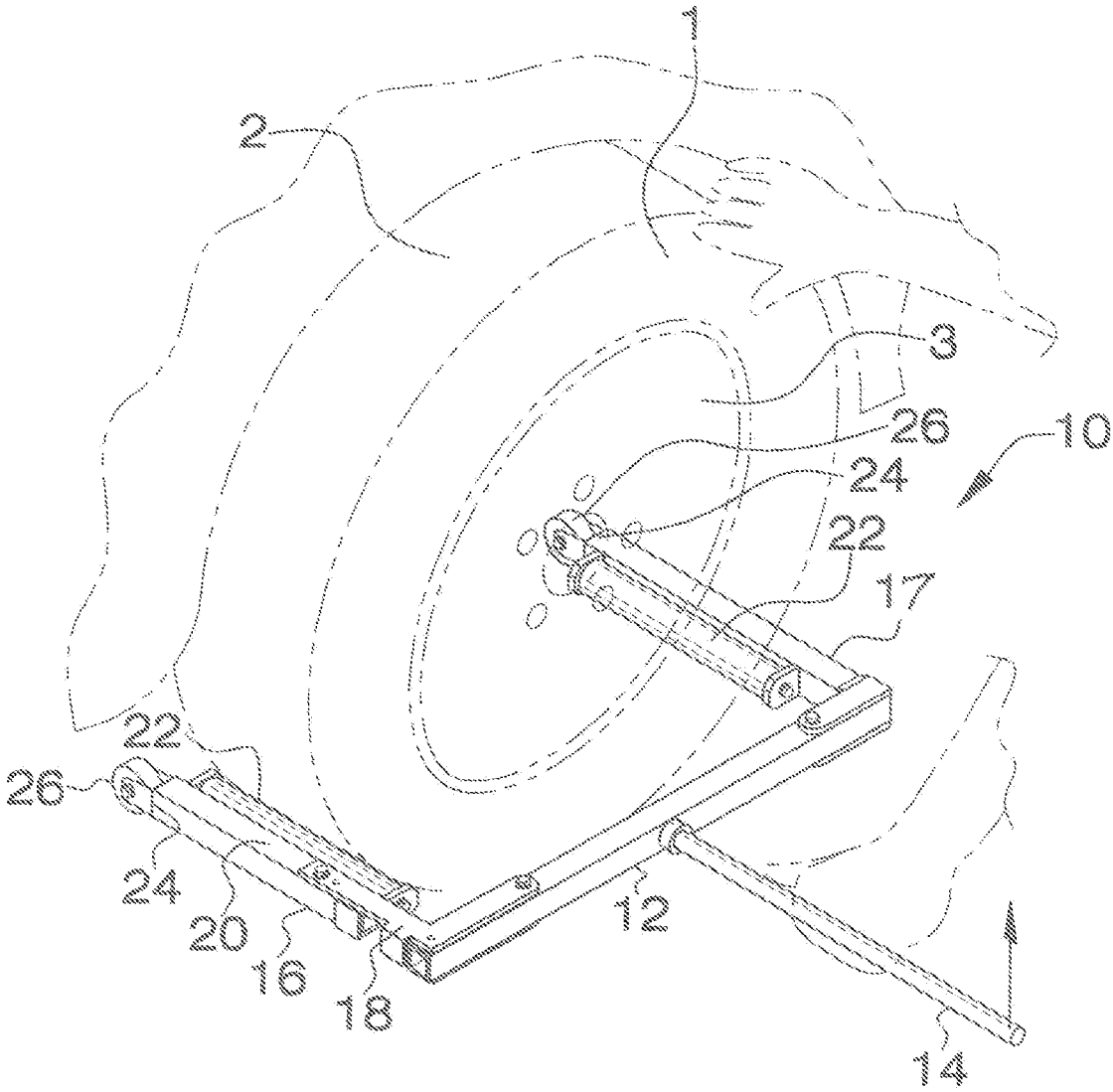
FIG. 1 is a perspective view of a wheel lifting device according to the present invention shown in use.
Figure 2:
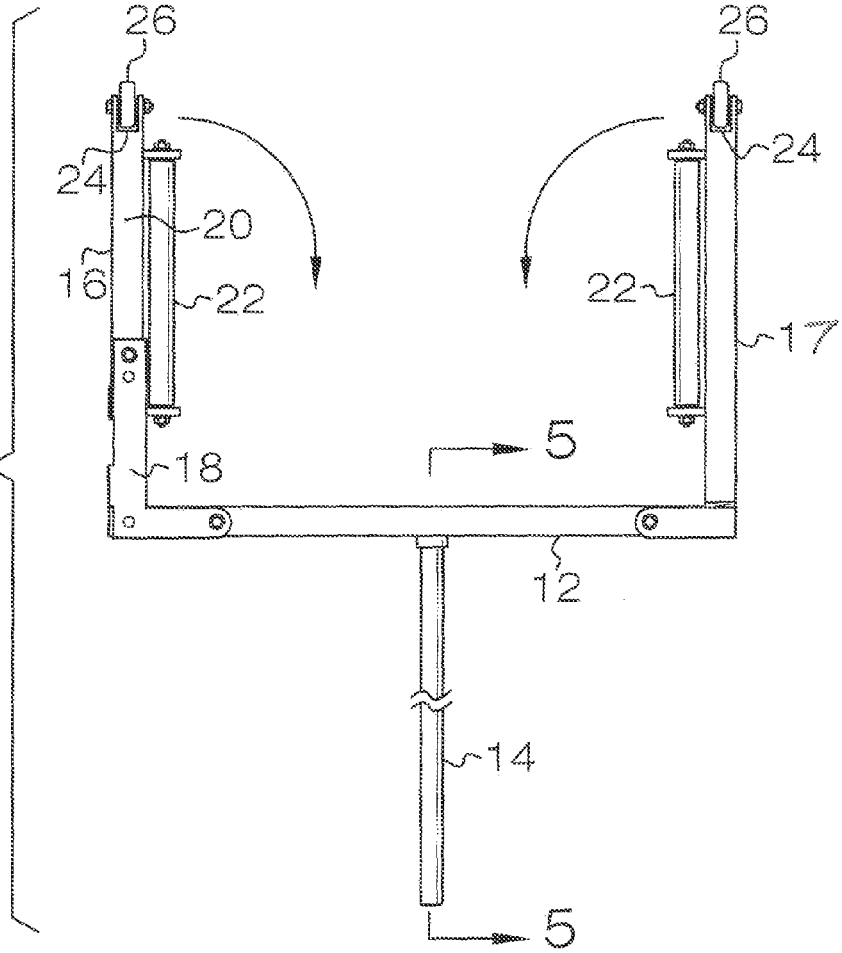
FIG. 2 is a top view of the present invention with the arms in the deployed position.
Figure 3:
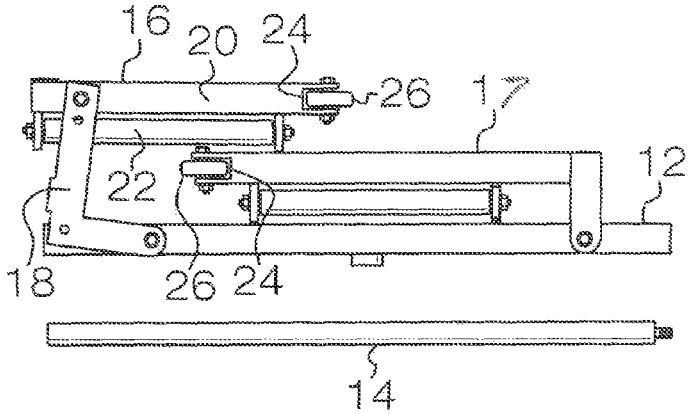
FIG. 3 is a top view of the present invention with the arms in the stored position.
Figure 4:
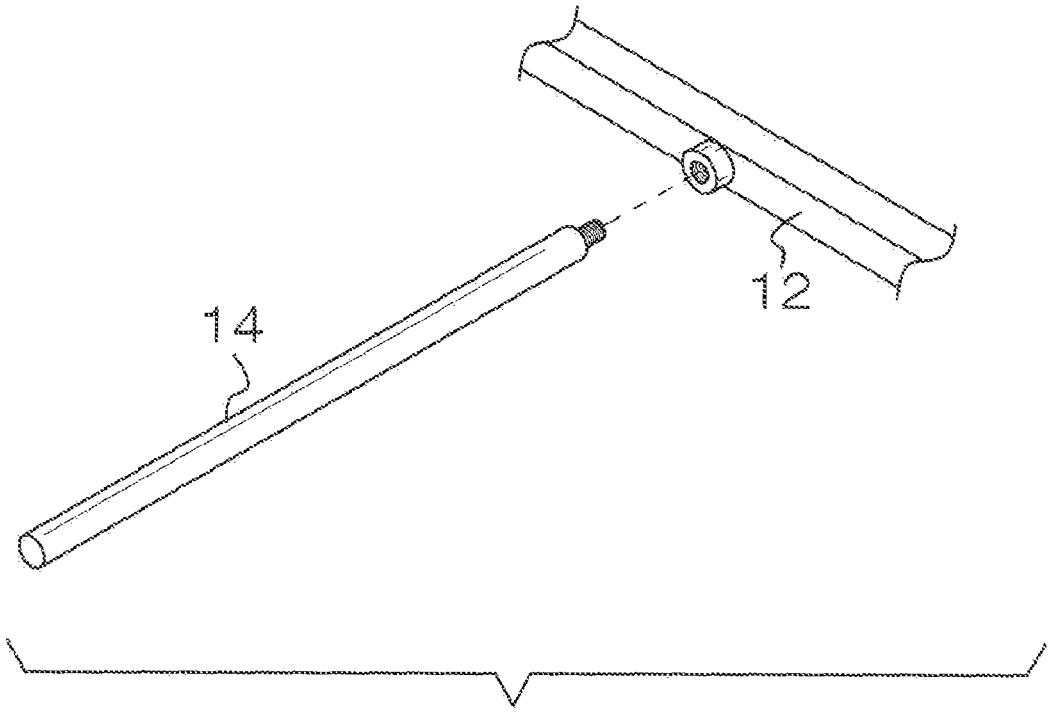
FIG. 4 is a perspective view of the present invention shown in the handle exploded from the base bar.
Figure 5:
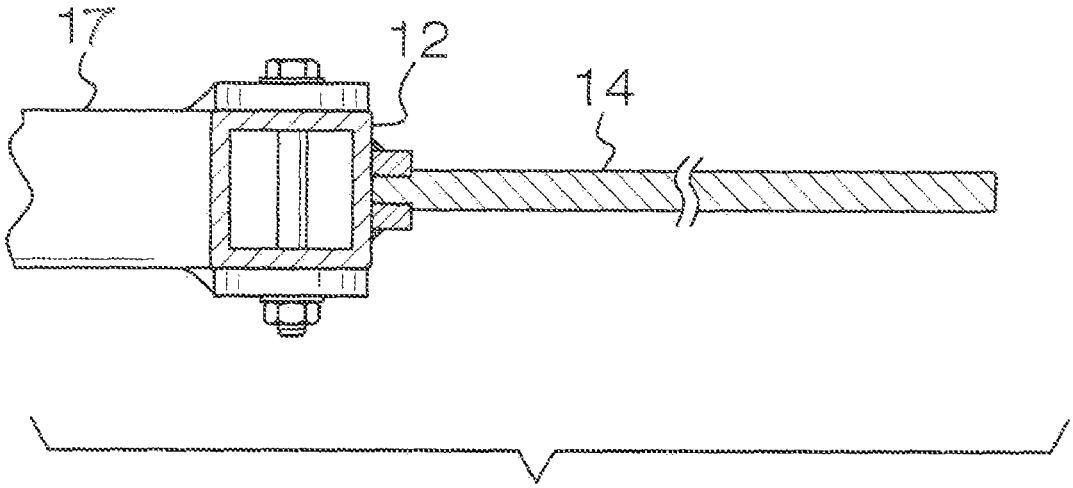
FIG. 5 is a cross-sectional view of the present invention taken along line 5-5 of FIG. 2.

With reference now to the drawings, and in particular to FIGS. 1 through 5 thereof, a new wheel pulling and transporting device embodying the principles and concepts of the present invention and generally designated by the reference numeral 10 will be described.

As best illustrated in FIGS. 1 through 5, the wheel lifting device 10 generally comprises a base bar 12 being positionable on a support surface adjacent a tire 1. A handle 14 is couplable to the base bar 12. The handle 14 is graspable to facilitate lifting of the base bar 12 and the tire 1. Each of a pair of arms 16, 17, more particularly including a first arm 16 and a second arm 17, is pivotally coupled to the base bar 12. Each of the arms 16, 17 is pivoted between a stored position and a deployed position. The stored position is defined by each of the arms 16, 17 being positioned approximately parallel and adjacent to the base bar 12. The deployed position is defined as the arms 16, 17 being positioned approximately perpendicular to the base bar 12.

The first arm 16 includes a first portion 18 and a second portion 20. The first portion 18 is pivotally coupled to the base bar 12. The second portion 20 is pivotally coupled to the first portion 18 opposite the base bar 12. The second portion 20 is pivoted with respect to the first portion 18 to position the second portion 20 of the first arm 16 adjacent the second arm 17 when the arms 16, 17 are positioned in the stored position.

Each of the arms 16, 17 has one of a pair of rollers 22 rotatably coupled thereto. Each of the rollers 22 is positioned between the arms 16, 17 to engage a tread 2 of the tire 1 when the arms 16, 17 are in the deployed position. The rollers 22 permit rotation of the tire 1 to allow a rim 3 to be rotated to properly align the rim 3 with a wheel hub. The rollers 22 are coupled to the second portion 20 of the first arm 16. Each of the arms 16, 17 has a free end 24. Each of the free ends 24 has one of a pair of wheels 26 rotatably coupled thereto. Each of the wheels 26 rolls across the support surface to facilitate transportation of the tire 1 when the arms 16, 17 are in the deployed position and the base bar 12 is lifted off the support surface.

In use, the arms 16, 17 are pivoted to the deployed position. The arms 16, 17 are positioned on opposite sides of the tire 1. The handle 14 is grasped and the base bar 12 lifted to support the tire 1 on the arms 16, 17. The wheels 26 are rolled across the support surface to transport the tire 1 to desired location. When the tire 1 is being positioned on the wheel hub the handle 14 is lifted to position the tire 1 at the correct height and the rollers 22 allow the tire 1 to be rotated to properly align the rim 3 with the wheel hub.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A wheel lifting device for facilitating manipulation of a tire, said device comprising:

a base bar being positionable on a support surface adjacent the tire;

a pair of arms defining a first arm and a second arm, each of said arms being coupled to said base bar, each of said arms being pivotally coupled to said base bar, each of said arms being pivoted between a stored position and a deployed position, said stored position being defined by each of said arms being positioned approximately parallel and adjacent to said base bar, said deployed position being defined as said arms being positioned approximately perpendicular to said base bar, said first arm including a first portion and a second portion, said first portion being pivotally coupled to said base bar, said second portion being pivotally coupled to said first portion opposite said base bar, said first and second portions being pivotable in a same plane, said second portion being pivoted with respect to said first portion to position said second portion of said first arm adjacent said second arm when said arms are positioned in said stored position; and a pair of rollers, each of said arms having one of said rollers rotatably coupled thereto, each of said rollers being positioned between said arms to engage a tread of the tire, said rollers permitting rotation of the tire to allow a rim to be rotated to properly align the rim with a wheel hub.

2. The device according to claim 1, further comprising a pair of wheels, each of said arms having a free end, each of said free ends having one of said wheels rotatably coupled thereto, each of said wheels rolling across the support surface to facilitate transportation of the tire when said arms are in said deployed position and said base bar is lifted off the support surface.

3. The device according to claim 1, further comprising a handle being couplable to said base bar, said handle being graspable to facilitate lifting of said base bar and the tire.

4. A wheel lifting device for facilitating manipulation of a tire, said device comprising:

a base bar being positionable on a support surface adjacent the tire;

a pair of arms defining a first arm and a second arm, each of said arms being pivotally coupled to said base bar, each of said arms being pivoted between a stored position and a deployed position, said stored position being defined by each of said arms being positioned approximately parallel and adjacent to said base bar, said deployed position being defined as said arms being positioned approximately perpendicular to said base bar, said first arm including a first portion and a second portion, said first portion being pivotally coupled to said base bar, said second portion being pivotally coupled to said first portion opposite said base bar, said second portion being pivoted with respect to said first portion to position said second portion of said first arm adjacent to said second arm when said arms are positioned in said stored position, said first and second portions being pivotable in a same plane a plane of pivoting of said arms;

a pair of rollers, each of said arms having one of said rollers rotatably coupled thereto, each of said rollers being positioned between said arms to engage a tread of the tire when said arms are in said deployed position, said rollers permitting rotation of the tire to allow a rim to be rotated to properly align the rim with a wheel hub, said roller on said first arm being coupled to said second portion;

a pair of wheels, each of said arms having a free end, each of said free ends having one of said wheels rotatably coupled thereto, each of said wheels rolling across the support surface to facilitate transportation of the tire when said arms are in said deployed position and said base bar is lifted off the support surface; and a handle being couplable to said base bar, said handle being graspable to facilitate lifting of said base bar and the tire.

5. The device according to claim 1, wherein said roller on said first arm is attached to said second portion, said roller extending through said first portion when said arms are in said stored position.

6. The device according to claim 4, wherein said roller on said first arm is attached to said second portion, said roller extending through said first portion when said arms are in said stored position.

* * * * *